United States Patent [19]

Jacobs

[11] 4,279,358

[45] Jul. 21, 1981

[54] CONTAINER LID

[76] Inventor: Stanley A. Jacobs, 45 Kohary Dr., New Haven, Conn. 06515

[21] Appl. No.: 64,062

[22] Filed: Aug. 6, 1979

[51] Int. Cl.[3] ..... B65D 45/34; B65D 41/16; B65D 43/10

[52] U.S. Cl. ..... 220/321; 220/306; 220/354; 215/DIG. 1

[58] Field of Search ..... 220/306, 321, 322, 354, 220/90, 320; 215/DIG. 1

[56] References Cited

U.S. PATENT DOCUMENTS

| | | | |
|---|---|---|---|
| 2,084,084 | 6/1937 | Greer | 220/354 |
| 3,255,907 | 6/1966 | Eddy | 215/DIG. 1 |
| 3,325,044 | 6/1967 | McCutcheon | 220/306 |
| 3,392,873 | 7/1968 | Old | 220/306 |
| 3,499,574 | 3/1970 | Yates | 220/320 |
| 3,510,023 | 5/1970 | Ullman | 220/90 |
| 3,531,013 | 9/1970 | Hammes | 220/306 |

FOREIGN PATENT DOCUMENTS

| | | | |
|---|---|---|---|
| 230463 | 10/1958 | Australia | 220/306 |
| 1007177 | 10/1965 | United Kingdom | 220/306 |

*Primary Examiner*—George E. Lowrance
*Attorney, Agent, or Firm*—Wolf, Greenfield & Sacks

[57] ABSTRACT

A one-piece molded plastic lid for a container is provided with a surrounding depending sidewall having a thin web portion which deforms as the lid is snap-fitted onto the container. The lid is intended to be used with containers having a protruding lip extending about the mouth of the container such as a paint can. The deformable web stretches into close conformity and sealing engagement with the lip, the lower regions of the skirt serving to maintain the web in a tightly constricted configuration about the lip.

7 Claims, 4 Drawing Figures

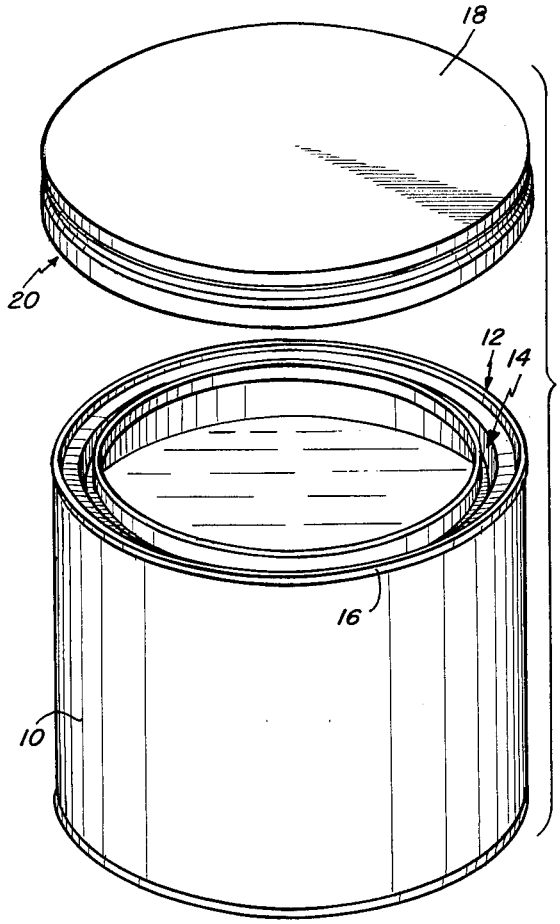
Fig.1
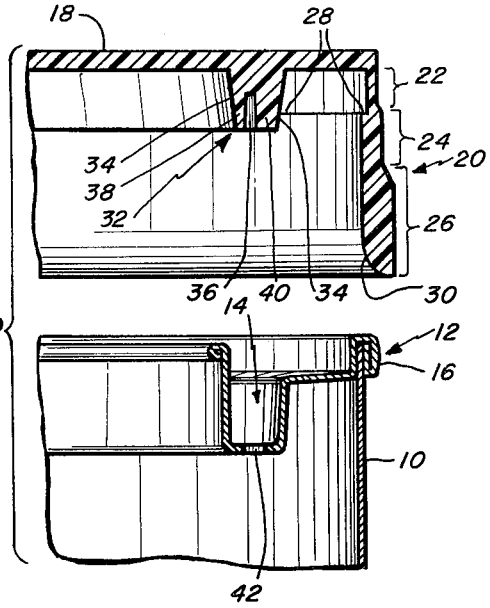
Fig.2
Fig. 3
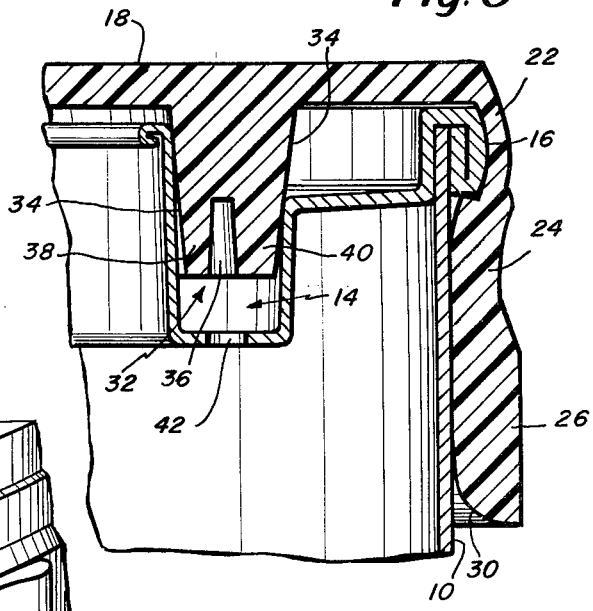
Fig. 4
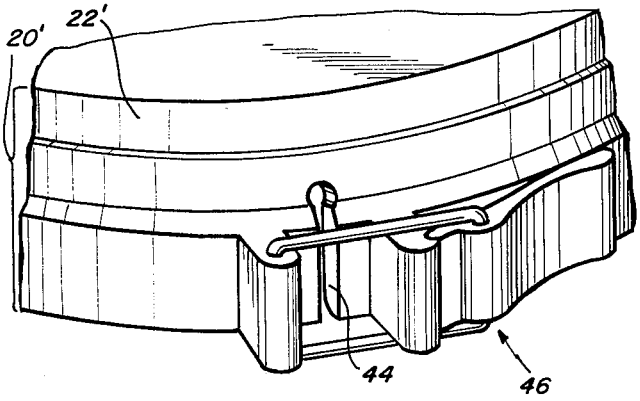

CONTAINER LID

BACKGROUND AND SUMMARY OF THE INVENTION

This invention relates to improvements in container lids and, particularly, to lids for use with wide open-mouth containers. For example, the container lid of the present invention is useful particularly in connection with paint cans although it may be used in other environments where it is desired to securely cover a wide-mouth container having a lip extending about the periphery of the container.

Typically, paint cans are formed from suitable metal, usually steel, provided with a peripheral lip and a channel, both of which are intended to provide suitable seal with the usual metal lid. When the paint cans are sealed at the factory, the seal usually is satisfactory. However, the can usually is opened with a prying tool such as a screwdriver which often results in deformation of the can and/or lid in a manner which may disrupt the cooperative seal between the can and the metal lid. As a result, when the can is re-covered, it is not uncommon for the seal to be insufficient, which, in turn, results in hardening and/or evaporation of the paint or other material in the container. In addition, improper sealing of the lid which may result from deformation of the lid seal, can result in leaks.

The present invention provides an improved container lid which is molded in a single integral piece from a suitable plastic material. The lid includes a top wall and a sidewall which extends downwardly from the periphery of the top wall. The upper portion of the sidewall is relatively thin to define a stretchable, deformable web. The lower portion of the skirt defines a relatively thick band of the plastic material which is less deformable than the web. The inner surface of the sidewall, at the juncture of the web and the lower sidewall portion, defines a shoulder which is intended to engage the underside of the lip at the upper end of the container. When the lid is pressed onto the container, the lower portions of the sidewall stretch outwardly to accommodate the lip. When the lid is pressed fully to a seated configuration, the shoulder snaps beneath the container lip and the lower band maintains a constricting force which maintains the shoulder in engagement with the lip. The height of the web is such that the web is caused to stretch and deform into snug sealing conformity with the container lip as the lid is pressed into place.

When used in connection with a container having a channel, such as a paint can, the lid may be provided with a sealing band molded integrally with and extending downwardly from the underside of the top wall. In a further modification, the sidewall may be interrupted and a latch may span the interruption to enable a secondary mechanical constricting force to be applied to the lid sidewall.

It is among the objects of the invention to provide an improved lid for a wide, open-mouth container, such as a paint can.

Another object of the invention is to provide a molded, one-piece plastic lid which snap-fits onto the container and which has a stretchable portion which is stretched tightly against a region of the container mouth to affect the firm seal.

A further object of the invention is to provide a container lid of the type described which may be used and reused without destroying its sealing capabilities.

DESCRIPTION OF THE DRAWINGS

The foregoing and other objects and advantages of the invention will be appreciated more fully from the following further description thereof, with reference to the accompanying drawings wherein:

FIG. 1 is an illustration of a separated container and lid in accordance with the invention;

FIG. 2 is a cross-sectional illustration of the outer regions of the lid and container;

FIG.3 is an enlarged cross-sectional illustration of the lid in sealed engagement with the mouth of the container; and FIG. 4 is an illustration of a modified embodiment of the lid.

DESCRIPTION OF THE PREFERRED EMBODIMENT

FIG. 1 illustrates a typical paint can which is generally cylindrical having a sidewall 10 which terminates at its upper end in a conventional wide-mouth configuration. The upper end of the can sidewall 10 includes a rim, indicated generally at 12 which may be stamped integrally with the can sidewall or formed as a separate piece and crimped to the upper end of the sidewall. The rim 12 typically is formed to define a circular channel 14 at its inner regions and a lip 16 at its outer periphery. The circumferential lip 16 protrudes radially outwardly of the sidewall of the can 10.

The lid may be molded in a single piece from a suitable plastic material such as low or medium density polyethelyne. The lid includes a top wall 18 and a downwardly extending sidewall, indicated generally at 20, extends downwardly from the periphery of the top wall 18. The lid sidewall is formed to define at least two and preferably three annular segments including a web segment 22, an intermediate segment 24 and a lower segment 26. The lid is dimensioned so that the inner diameter of the intermediate and lower segments 24, 26 is substantially equal to the outside diameter of the container sidewall 10. The inside diameter of the web segment 22 is greater than the outside diameter of the container sidewall 10, thereby defining an undercut region and a shoulder 28 near the juncture of the web segment 22 and intermediate segment 24. The web segment 22 is relatively thin and, for example, may be of the order of 0.025 inches thick. The intermediate segment 24 is substantially thicker than the web segment 22 and, for example, may be of the order of 0.060 inches thick. The lower segment 26 may be of the order of 0.100 inches thick. The lower edge of the lid sidewall 20 may be bevelled or smoothly curved as indicated at 30 to facilitate expansion of the sidewall 20 as it is urged over the circumferential lip 16 of the container.

The lid is attached to the container by press-fitting it over the rim 12. As the bevelled, lower edge 30 of the lid sidewall 20 is urged downwardly against the lip 16 of the container, the relatively thick lower and intermediate segments 26, 24 are forced radially outwardly to expand as the lid is urged progressively onto the container. As the lid is advanced to cause the web segment 22 to advance toward the lip, the relatively thin web segment 22 will be stretched to a longer and thinner configuration and will tend to wrap itself snugly and intimately about the lip 16 of the container as suggested in FIG. 3. The height of the web segment 22 is such that when the lid is fully seated with the top wall 18 in engagement with the upper edge of the lip 16, the shoulder 28 will be in proximity to the underside of the container lip 16, with the intermediate segment 24 still in its expanded configuration. Because of the substantially greater thickness of the intermediate segment 24, it will have a greater elastic memory than the thinner web segment 22. When the shoulder 28 reaches the level of the underside of the lip 16, the elasticity of the intermediate segment 24 will cause the segment 24 to return to its original configuration and constrict about the can sidewall 10. The elastic constricting force of the intermediate segment 24 causes the web segment 22 to be stretched slightly further and draws the shoulder 28 firmly and substantially fully beneath the underside of the lip 16. When fully seated, the web segment 22 is in a stretched configuration and is partly and tightly wrapped about the lip 16. The lid is maintained in its configuration by engagement of the shoulder 28 with the underside of the lip 16 which, in turn, is secured by the constricting effect of the relatively thick intermediate and lower segments 24, 26.

As illustrated in the drawings, the lid also may include a sealing ring 32 which is molded integrally with the lid. The sealing ring is integral with and extends downwardly from the underside of the lid top wall 18 and is dimensioned so that it will be received in the channel 14 at the container rim 12. The cross section of the sealing ring 32 preferably defines a pair of downwardly tapering sidewalls 34 and a groove 36 which defines a pair of downwardly extending fingers including an inner finger 38 and outer finger 40. Each of the fingers 38, 40 is tapered downwardly in cross section. One of the fingers preferably is substantially thinner than the other so that it will be more flexible to facilitate seating of the ring 32 in the channel 14. Thus, as shown, the inner finger 38 is substantially thinner than the outer finger. As the lid is pressed into its seated and secured configuration, the fingers 38, 40 will enter the channel 14 and the inner finger will be able to flex in a generally radial direction to facilitate full sealing and seating engagement of the ring 32 in the channel 14. When the lid is provided with the sealing ring 32, it is preferred to form a channel 14 with a plurality of drain holes 42 to enable any trapped paint or other liquid to be urged out of the channel 14 and not interfere with full seating of the ring 32.

FIG. 4 shows a modified form of the invention in which the lower region of the lid sidewall 20' is interrupted, as by a slot 44. The lower regions of the sidewall lid 20 are caused to constrict about the sidewall 10 of the container by a latching device indicated generally at 46. The latching device 45 may be of any convenient construction sufficient to draw the sidewall 20' tightly about the can sidewall 10 to stretch the web segment 22' about the lip 16 of the container and to secure the shoulder 28 in firm engagement beneath the lip 16.

From the foregoing it will be appreciated that I have provided a one-piece, integral molded container lid suitable for use with paint cans or the like in which a firm and effective seal is achieved by causing a thin segment of the lid sidewall to be stretched and wrapped about the protruding lip of the container sidewall 10. It should be understood, however, that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A lid for a container having a sidewall and a lip protruding radially outwardly from the sidewall and extending about the periphery of the upper end of the container sidewall, the lid being formed from resilient plastic material and comprising:

a top wall;

a relatively thin sidewall web segment extending downwardly from the periphery of the top wall;

a relatively thick skirt integral with and extending downwardly from the lower end of the web, said skirt and web being dimensioned so that the skirt will display a greater resistance to radial expansion than the web;

the inner surface of the web defining a greater diameter than the inner surface of the skirt portion, thereby to define an inwardly-facing shoulder, the shoulder being spaced from the underside of the lid top wall by an amount substantially equal to the height of the container lip;

whereby the lid may be snap-fitted onto the container;

said web being sufficiently thin, and being dimensioned with respect to the container lip so that snap-fitting of the lid onto the container will require the web to stretch heightwise and to deform to and wrap around the outer periphery of the container lip when the shoulder is engaged with the underside of the container lip, said skirt portion being disposed below the container lip and being constructed and arranged as to retain web portion into firm and snug sealing engagement with the container lip.

2. A lid as defined in claim 1 further comprising:

the inner diameter of the skirt being substantially equal to the outer diameter of the container sidewall; and the inner diameter of the web lying within an annulus, the inner diameter of which is greater than the outer diameter of the container sidewall and in which the outer diameter of which is no greater than the outside diameter of the container lip.

3. A lid as defined in claim 2 formed from low to medium density polyethylene, said web segment being of the order of 0.025 inches thick, and the skirt being of the order of at least 0.060 inches thick.

4. A lid as defined in claim 1 wherein the container has a channel extending about the container opening radially within the protruding lip, said lid further comprising;

a sealing ring molded integrally with and extending downwardly from the underside of the lid, the sealing ring being dimensioned with respect to the channel so as to be received in the channel.

5. A lid as defined in claim 4 wherein the sealing ring includes a pair of downwardly tapering sidewalls and a groove extending upwardly from and into the bottom of the sealing ring, the groove defining a pair of downwardly extending fingers including an inner and outer finger, each of the fingers being tapered downwardly in cross section.

6. A lid as defined in claim 5 wherein one of the fingers of the sealing ring is substantially thinner than the other in cross section.

7. A lid for a container having a sidewall and a lip protruding radially outwardly from the sidewall and extending about the periphery of the upper end of the container sidewall, the lid being formed from resilient plastic material and comprising:

a top wall;

a relatively thin sidewall web segment extending downwardly from the periphery of the top wall;

a relatively thick skirt integral with an extending downwardly from the lower end of the web, said skirt and web being dimensioned so that the skirt will display a greater resistance to radial expansion than the web;

the inner surface of the web defining a greater diameter than the inner surface of the skirt portion, thereby to define an inwardly-facing shoulder, the shoulder being spaced from the underside of the lid top member by an amount substantially equal to the height of the container lip;

the skirt portion being formed with an interruption; and latch means mounted to the skirt on opposite sides of the interruption, the latch means being constructed and arranged to draw the skirt on opposite sides of the interruption circumferentially toward each other thereby to effect a circumferential constricting force on the skirt, the latch means being constructed and arranged to secure the skirt in its constricted configuration;

whereby the lid may be fitted onto the container and upon operation of the latch to constrict the skirt, the web will deform to the cross sectional contour of the container lip with the shoulder being urged into engagement with the underside of of the lip, said web being sufficiently thin, and being dimensioned with respect to the container lip so that upon operation of the latch, the web will stretch heightwise and will wrap around the outer periphery of the container lip.

* * * * *